US010329110B2

(12) United States Patent
Dotta

(10) Patent No.: US 10,329,110 B2
(45) Date of Patent: Jun. 25, 2019

(54) REEL-CHANGING APPARATUS PARTICULARLY SUITABLE FOR FEEDING WORKING MACHINES

(71) Applicant: Angelo Dotta, Bologna (IT)

(72) Inventor: Angelo Dotta, Bologna (IT)

( * ) Notice: Subject to any disclaimer, the term of this patent is extended or adjusted under 35 U.S.C. 154(b) by 0 days.

(21) Appl. No.: 15/329,407

(22) PCT Filed: Jul. 31, 2015

(86) PCT No.: PCT/IB2015/055831
§ 371 (c)(1),
(2) Date: Jan. 26, 2017

(87) PCT Pub. No.: WO2016/016866
PCT Pub. Date: Feb. 4, 2016

(65) Prior Publication Data

US 2017/0210586 A1 Jul. 27, 2017

(30) Foreign Application Priority Data

Aug. 1, 2014 (IT) ..... AN14A0120

(51) Int. Cl.

| | |
|---|---|
| ***B65H 19/30*** | (2006.01) |
| ***B65H 16/02*** | (2006.01) |
| ***B65H 16/04*** | (2006.01) |
| ***B65H 19/18*** | (2006.01) |
| ***B65H 19/26*** | (2006.01) |

(52) U.S. Cl.
CPC ..... *B65H 19/30* (2013.01); *B65H 16/021* (2013.01); *B65H 16/04* (2013.01); *B65H 19/1847* (2013.01); *B65H 19/1868* (2013.01); *B65H 19/265* (2013.01); *B65H 2301/46024* (2013.01); *B65H 2301/4631* (2013.01); *B65H 2301/4641* (2013.01); *B65H 2406/30* (2013.01); *B65H 2406/351* (2013.01); *B65H 2408/2412* (2013.01); *B65H 2408/24153* (2013.01)

(58) Field of Classification Search
CPC ..... B65H 19/30; B65H 19/265
See application file for complete search history.

(56) References Cited

U.S. PATENT DOCUMENTS 7,980,504 B2 * 7/2011 Butterworth ..... B65H 19/1847 242/554
2010/0264248 A1 10/2010 Butterworth
2013/0248640 A1 * 9/2013 Niwa ..... B65H 19/26 242/522

FOREIGN PATENT DOCUMENTS

WO 0056645 A1 9/2000

* cited by examiner

*Primary Examiner* — Sang K Kim
(74) *Attorney, Agent, or Firm* — Howson & Howson LLP

(57) ABSTRACT

Apparatus suitable for guaranteeing a quick and automatic change of materials wound on reels, said apparatus consisting mainly of a reel-alternating mechanism combined with a mechanism for cutting and reconnecting the reeled material.

10 Claims, 2 Drawing Sheets

REEL-CHANGING APPARATUS PARTICULARLY SUITABLE FOR FEEDING WORKING MACHINES

TECHNICAL FIELD

The subject-matter of the invention is a combination of mechanisms suitable for guaranteeing a quick and automatic change of materials wound on reels, with substitution of exhausted reels with fresh ones that replace the former ones and continue the work after reconnecting the reeled material.

PRIOR ART

Nowadays it is usual, in working machines of common use, to change reels by means of a manual operation while the machine is not running, said operation comprising cutting of the remaining material from the exhausted reel, dismounting the reel (i.e. its core), mounting a fresh reel and connecting the leading edge thereof to the remaining trailing edge of the exhausted reel; after these operations the machine can be re-started. The service time can be quite reduced by adopting two reel-holders located in the working position and to be alternated in feeding the same material; however, this may involve problems of overall dimensions as well as of safety for the operators if they have to intervene on one of the two reels for replacing it while the machine is running.

A main object of the invention is to solve the aforementioned problems by providing a solution that is industrially applicable in a cost-effective way.

SUMMARY OF THE INVENTION

The term "reel-holder" here means a spindle that is rotatable around its axis and on which a reel of material to be unwound is mounted; something completely different is, instead, a rewind reel-holder, in which the spindle is motor-driven for forming a reel of wound material.

The apparatus according to the invention consists mainly of a mechanism for cutting and reconnecting the reeled material; such mechanisms are briefly described here below by way of example.

The reel-changing apparatus according to the invention is particularly suitable for feeding working machines and comprises at least:

- an element rotatable around itself and carrying two or more reel-holders, the whole forming substantially a carousel;
- supporting and guiding means allowing said rotatable element to be brought to the working point and moved away from it;
- means for the guided rotation of said rotatable element, said means allowing to alternate each of the reel-holders in the same angular working position;
- means for displacing said rotatable element, said means allowing to bring said element away toward the outside and, after its rotation, to retract it by bringing again one of the reel-holders in the working position.

The rotatable element equipped with reel-holders is fixed to a carriage slidable on guides and is moved forward and backward by a piston attached to the carriage itself, whereas the shaft protruding from the piston is anchored to the guide support, the attachment of the piston and/or the anchoring of the shaft being adjustable through adjusting means adapted to establish the working position of the reel-holders.

For rotation of the element with the reel-holders around itself there is provided an axial gear engaged by a toothed rack which is freely slidable longitudinally for a certain distance and is then blocked by a stop, preferably an adjustable stop.

The axial gear is mounted on a one-way bearing which becomes engaged when the rotatable element with the reel-holders moves away from the working position and becomes disengaged when it is retracted to said position.

The reel-holders have protrusions adapted to engage into a clutch device or reel-unwinding control device, said engagement being provided upon retraction of each reel-holder to the working position.

The reel-changing apparatus is particularly suitable for feed working machines and comprises:

- an abutment element which inserts itself near the reeled material when the latter is close to exhaustion, said abutment element being retractable;
- a device blocking the flow of said material downstream of the exhausted reel;
- a mobile element which, abutting against the abutment element, causes cutting of the material, while holding, attached to itself, an edge of the material of the exhausted reel, and then moves, thus leaving space for the entrance of a fresh reel, onto which it subsequently intervenes by engaging the leading edge of the fresh reel with the held edge from the former exhausted reel.

The retractable abutment element is sharp.

The mobile element which abuts against the abutment element is an oscillating arm provided with air suction adapted to hold an edge of the cut material.

BRIEF DESCRIPTION OF THE DRAWINGS

Some embodiments of the invention will be described by way of non-limiting example with reference to the annex drawings, in which.

DESCRIPTION OF SOME PREFERRED EMBODIMENTS

Figure 1:
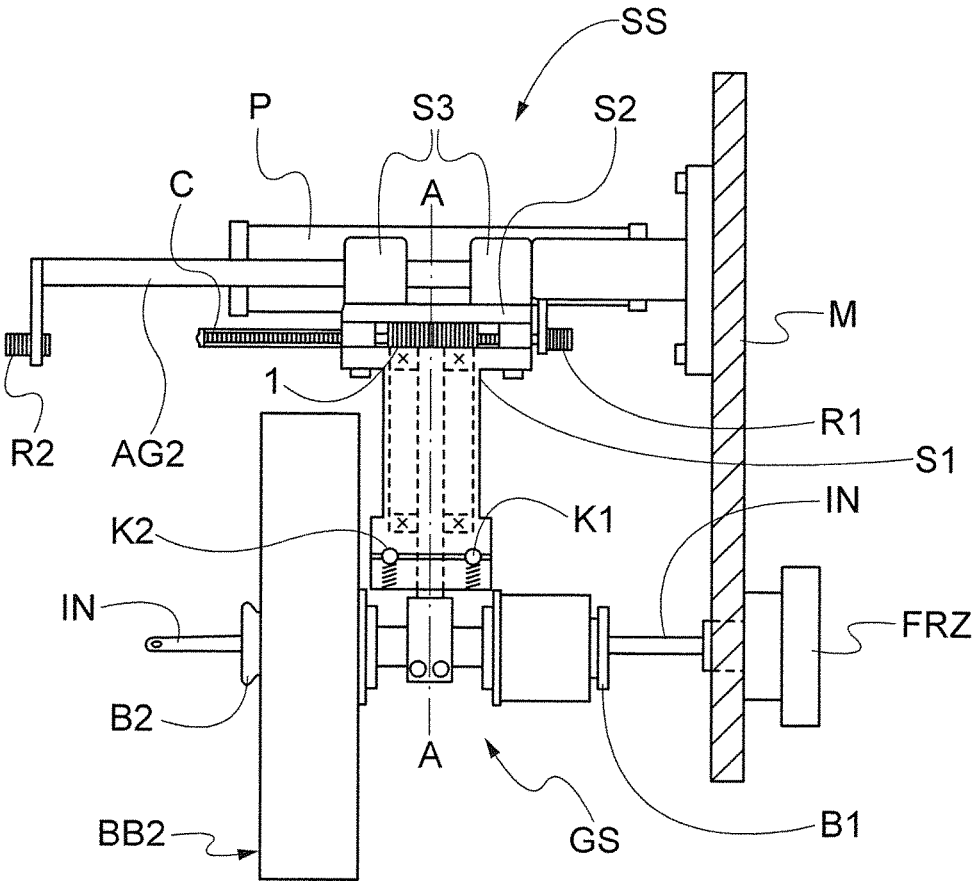
FIG. 1 is a schematic side view of the apparatus.

As illustrated in FIG. 1, the two opposite reel-holders B1,B2 are fixed to the rotating shaft A, thus forming a carousel GS which is supported by the composite assembly SS; said assembly comprises a flanged tubular element S1—which houses the bearings supporting the rotating shaft A—connected, by means of screws provided with spacers, to the plate S2 to which backing elements S3, which are hollow and provided inside with ball sleeves or bushes, are fixed. This composite assembly SS, defined in short as "carriage" is slidably fit onto the two guiding shafts AG1 AG2, as better visible in FIG. 2, and is controllable forward and backward (relative to the machine wall M) by means of the pneumatic piston P.

Figure 2:
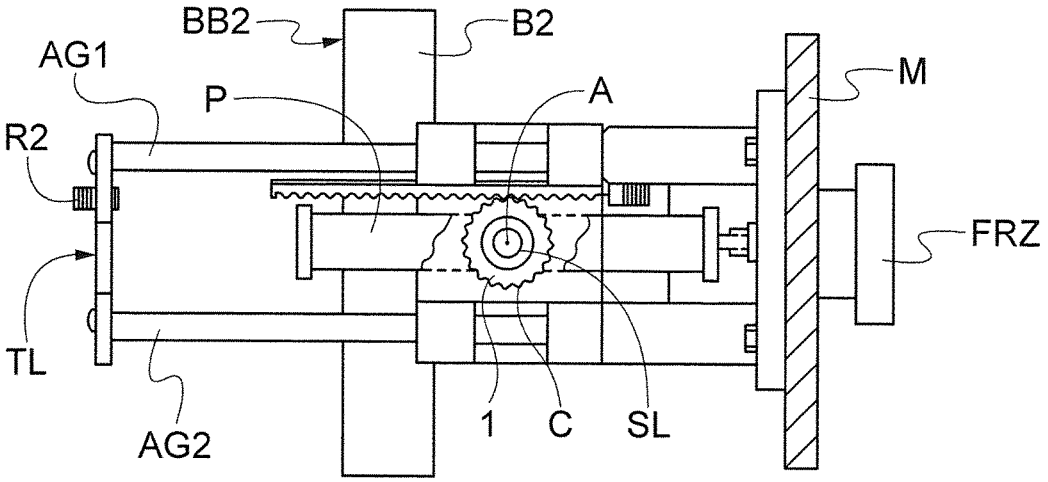
FIG. 2 is a schematic top view of the apparatus of FIG. 1.

FIG. 2 (top view) also shows the toothed rack C, slidably inserted into the carriage SS, and the gear 1 which is coaxial with the shaft A and connected thereto and is in engagement with the toothed rack C; the rack can come into contact with the two abutment elements R1,R2 fixed to the support frame TL.

FIG. 1 shows that the reel-holder B1, in the working position, has already exhausted the material from its reel, whereas the reel-holder B2 (in an outer position relative to the working path) has a fresh reel; a composite operation is provided for making said fresh reel reach the working position.

By actuating the piston P, the carriage SS moves outwards, thus bringing both reel-holders B1,B2 out of the working path and guiding the toothed rack C into contact with the abutment element R2, and thereafter—by continuing the action of the piston P until its end stop—the gear 1 in engagement with the toothed rack C, which is blocked, is forced to rotate by 180° around itself together with the shaft A and the corresponding reel-holders B1,B2. As a consequence, the reel-holder B2 takes angularly the place formerly occupied by the reel-holder B1, turning the fresh reel towards the machine wall M; in order to take said fresh reel to the working position it is then necessary to actuate the piston P so as to retract it, while avoiding, however, that the return of the toothed rack C to the starting position brings about a counter-rotation by 180° of the shaft A; to this aim it is provided that the connection between the gear 1 and the shaft A is established by a one-way bearing SL which comes into engagement only when the action of the piston P is directed outwards. In order to prevent unwanted movements of the shaft A and of the corresponding reel-holders there are also provided two devices with spring-biased balls (so called "click" balls) indicated with K1,K2 in FIG. 1, which are arranged at 180° relative to each other and act upon corresponding semi-spherical recesses; when the shaft A with the reel-holders B1,B2 is rotated by the action, directed outward, of the piston P, the spring-biased balls are moved and slide by 180° until they insert themselves into the semi-spherical seats, without coming out of said seats when the piston P brings back the carriage SS inwards, the rotational impulse for the shaft A being prevented by a one-way bearing. When the reel-holder returns to its position, its corresponding protrusion IN is inserted into the clutch FRZ fixed to the machine wall; in this way proper control of the reel is guaranteed by means of a single clutch and perfect centering of each reel-holder B1,B2 in its working position is ensured even better. When the reel-holder B2 is brought again inward to its working position, the reel-holder B1 remains exposed outward, so that an operator can carry out interventions on it in total safety—even though the machine is running—for removing the core of the exhausted reel and mount a fresh reel. As working machines are usually equipped with transparent cabinet-like protections with doors that, when opened, stop the engines, suitable openable doors will be provided for the aforesaid interventions.

The solution illustrated for controlling reels is essentially mechanical, but an equivalent thereof can be the adoption of electrical controls, such as for instance an electronically controlled motor for rotating the reel-holding carousel GS, or an actuator, this too being electrical, for moving the carriage SS forward and backward.

It must be stressed once again that the proposed solutions are not exclusive for characterizing the invention, the scope of which is defined by the claims.

Now that the mechanism for alternating the reels has been described, the steps in which the reeled material is cut and reconnected are still to be examined, said steps being interposed with the steps, already described, of reel alternation; indeed, only after cutting of the remaining material from the reel of the reel-holder B1 the carriage SS can move outward, whereas the reconnection of the material T of the fresh reel is provided only after the fresh reel of the reel-holder B2 has been put in the working position. The correlation between the functions provided for the mechanisms already described and for those that are still to be described makes it necessary to consider them in an organic way from the patent viewpoint; nevertheless, as these technical solutions are not mutually necessary—meaning that the solution of the rotating carousel GS+carriage SS may not necessarily require the solution cutting-reconnection described here below, and vice versa—it is convenient to protect them with separate autonomous claims, though patent unity is satisfied.

Figure 3:
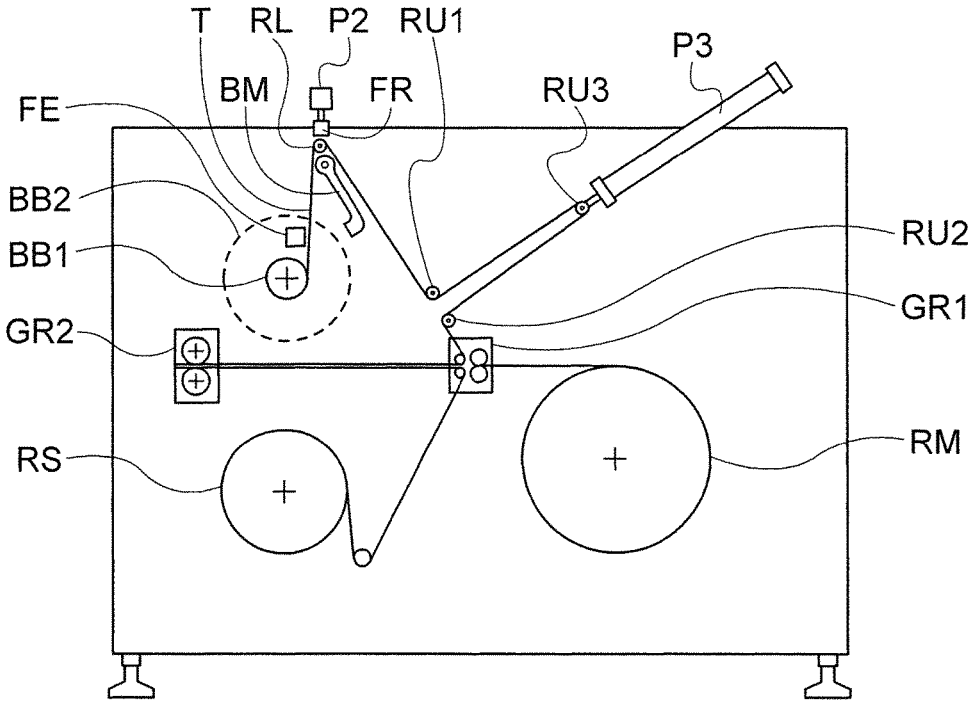
FIG. 3 is a schematic front view of the cutting and reconnecting mechanism.

The description of the cutting and reconnecting mechanism starts from the basic illustration of FIG. 3, which is a schematic front view of a packaging machine in which RM is the roll of material to be cut and packaged by means of the assembly GR1, where GR2 is the assembly for cutting the packages and RS and BB1 are the reels from which the material for making the packages is delivered. BB1 is the exhausted reel which is carried by the reel-holder B1 and is already visible in side view in FIG. 1 and is seen here from the front of the machine and is shown in transparency through the reel BB2 carried by the reel-holder B2—see the dashed circle BB2—which would actually hide it.

The provided steps start with signalling by a detector of the reel diameter, followed by blocking of the forward movement of the material T by means of the brake FR acting on the underlying roll RL through the piston P2; it is not necessary to concomitantly stop the machine, because the piston P3, adequately biased in advance before the reel BB1 becomes exhausted, has already created a stock of material (the so-called "buffer stock") which is sufficient, at low speed, for carrying out the provided step without stopping the machine.

Figure 4:
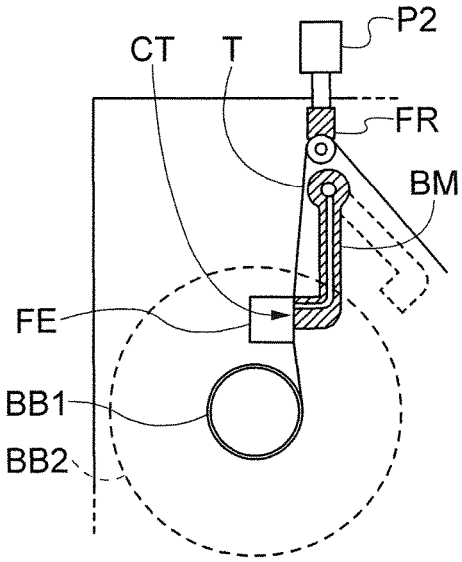
FIGS. 4 and 5 are enlarged views of a detail of the mechanism of FIG. 3 in as many working configurations.
Figure 5:
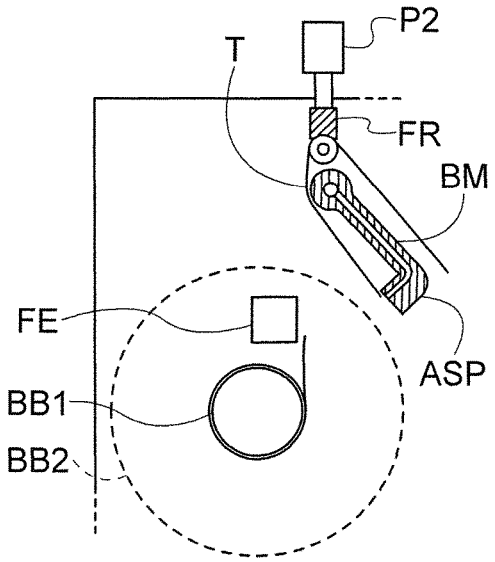

Simultaneously, a knife CT comes out of the slot FE—provided in the machine wall—and positions itself transversely behind the material T; immediately thereafter, a mobile counter-acting tool comprising a mobile arm BM equipped with a protrusion with a suction head ASP, moves against the front face of the material T and pushes it against the cutting edge of the transverse knife CT, cutting the material and holding its upper edge by air suction, whereas the lower edge remains attached to the core of the exhausted reel BB1 (see FIG. 4). Immediately thereafter, the mobile arm BM goes back to its starting position and entrains with it the upper edge of the material T, and simultaneously the transverse knife CT moves back into the slot FE, whereby there is free room for bringing a fresh reel BB2 to the working position by means of the assembly carriage SS+carousel GS already described above (see FIG. 5).

The fresh reel BB2 is placed so that its leading edge, suitably provided with an adhesive, or provided with an adhesive appendix, is directed towards the protrusion with suction head of the mobile arm BM; said arm immediately moves and brings the remaining upper edge of the material T into contact with the adhesive of the leading edge of the reel BB2, whereby a connection is created that restores the continuity of the material to be fed to the machine. At this point the suction by the arm BM ceases and therefore the arm becomes detached from the material and returns to its starting position, and the same is done by the brake FR by means of the piston P2; in the meantime, the "buffer stock" of material created by the piston P3 has become exhausted and the piston P3 has gradually returned to the condition provided for the machine working at full speed, once the phase at low speed necessary for the already described steps has been completed; consequently the shaft of the piston P3 comes out entirely, bringing the roll RU3 under the rolls RU1 and RU2, so that at full speed the path of the material T is rectilinear, undeflected by the action of the rolls; after that, the machine can start working again at full speed, after all the steps of reel alternation and cutting and reconnecting of the material have been performed in a few seconds.

The invention claimed is:

1. A reel-changing apparatus for feeding working machines, wherein there is provided an assembly for cutting and reconnecting a reeled material (T), comprising:

a mobile cutting tool (CT) positioned for intercepting a first face of the material (T) of a band unwound from a first reel (BB1) standing in a working position and exhausted or close to exhaustion;

a counter-acting tool (BM) capable of intercepting a second face of the material (T) of said band, at the cutting tool (CT), and provided with a suction head (ASP), said counter-acting tool being capable of moving from a rest position to a working position in contact with the material (T) of the band unwound from said first reel (BB1) exhausted or close to exhaustion;

wherein the mobile cutting tool (CT) and the counter-acting tool (BM) cooperate with each other for cutting the material (T) unwound from said first reel (BB1), wherein the counter-acting tool (BM) holds by air suction an edge of the material cut from said first reel (BB1) for bringing said edge to being reconnected to a leading edge of a second reel (BB2) brought to the working position by the reel-changing apparatus in replacement of the first reel (BB1), and wherein the mobile cutting tool (CT) is movable transversely with respect to the band (T) to be cut and is retractable for allowing insertion of a new reel.

2. The reel-changing apparatus according to claim 1, wherein the counter-acting tool comprises an oscillating aim (BM) assisted by a control unit programmed for:

causing forward movement of said oscillating aim from a rest position to a working position in contact with the material (T) of the band unwound from the first reel (BB1) standing in the working position;

switching on air suction through said suction head (ASP);

cooperating for cutting the material (T) of said band;

causing retraction of said arm from the working position to the rest position while maintaining active the air suction for holding the cut edge of the band;

causing forward movement of said arm for bringing the cut edge against the leading edge of a new reel;

causing retraction of said arm from the working position to the rest position after switching off air suction.

3. The reel-changing apparatus for feeding working machines according to claim 1, further comprising:

a mobile support (SS) capable of guided traveling motion;

a carousel (GS) rotatably supported by said mobile support (SS);

first and second reel-holders (B1,B2) connected to the carousel and arranged symmetrically with respect the rotation axis of the carousel, the first reel (BB1) being mounted on said first reel holder (B1) and the second reel (BB2) being mounted on the second reel holder (B2);

a movement actuating device (C,1) capable of causing rotation of the carousel (GS) around said axis, said device alternating each of the reel-holders (B1,B2) in the same angular working position;

a control device (P) that controls the guided traveling of said mobile support (SS) and is capable of causing retraction of the mobile support (SS) away from a working position and of causing the forward movement of the mobile support in the opposite direction once the carousel has performed one rotation around its rotation axis for bringing a second reel-holder (B2) to said working position.

4. The apparatus according to claim 3, wherein the mobile support (SS) comprises a carriage in which there are provided:

a flanged tubular element (S1) housing bearings of a rotating shaft (A) of a central rotating element;

a support plate (S2) connected to the flanged tubular element (S1);

hollow backing elements (S3) fixed to the support plate (S2) and internally equipped with ball sleeves or bushes slidable on guides; and wherein said guides comprise guiding shafts (AG1, AG2) fixed to a fixed part of the apparatus.

5. The apparatus according to claim 4, wherein the carriage comprises:

a toothed rack (C) slidably inserted in the carriage and parallel to said guides;

a gear (1) coaxial with the rotating shaft (A) of said central rotating element and connected thereto by means of a one-way or unidirectional bearing which engages with the toothed rack (C), said bearing becoming engaged when the mobile support (SS) retracts for moving the first reel-holder (B1) away from the working position and said bearing becoming disengaged when the mobile support (SS) moves forward for bringing said reel-holder to said working position;

a pair of abutment elements (R1,R2) fixedly arranged at the ends of the travel of the toothed rack (C).

6. The apparatus according to claim 5, wherein each reel-holder (B1, B2) comprises a corresponding rotating spindle having its own rotation axis, the first and second reels (BB1, BB2) of material to be unwound being mountable on one of the spindles, said spindles being provided with a protrusion (IN) capable of engaging into a clutch (FRZ) provided in a working machine to which the apparatus is associated.

7. The apparatus according to claim 4, wherein each reel-holder (B1, B2) comprises a corresponding rotating spindle having its own rotation axis, the first and second reels (BB1, BB2) of material to be unwound being mountable on one of the spindles, said spindles being provided with a protrusion (IN) capable of engaging into a clutch (FRZ) provided in a working machine to which the apparatus is associated.

8. A method for controlling a reel-changing apparatus intended for feeding working machines and made in accordance with claim 3, wherein the following the steps are provided:

detecting the approaching exhaustion of the material (T) unwound from the first reel (BB1) mounted on the reel-holder (B1) of the feeding apparatus standing in the working position;

blocking, either by stopping the machine to which the band of material (T) is fed or by means of a brake (FR), the forwarding movement of the material (T) unwound from the exhausting first reel (BB1) which is mounted on the reel-holder (B1) of the apparatus which stands in the working position;

cutting the material (T) unwound from said exhausting first reel;

driving retraction of the mobile support (SS) for bringing said exhausting first reel to the rest position;

causing rotation of the carousel (GS); and driving forward movement of the mobile support (SS) for bringing to the working position the second reel mounted on the second reel-holder (B2).

9. The apparatus according to claim 3, wherein each reel-holder (B1, B2) comprises a corresponding rotating spindle having its own rotation axis, the first and second reels (BB1, BB2) of material to be unwound being mountable on one of the spindles, said spindles being provided with a protrusion (IN) capable of engaging into a clutch (FRZ) provided in a working machine to which the apparatus is associated.

10. A method for controlling the reel-changing apparatus intended for feeding working machines according to claim 1, wherein the reel-changing apparatus further comprises a mobile support (SS) capable of guided traveling motion, a carousel (GS) rotatably supported by said mobile support (SS), and first and second reel-holders (B1,B2) connected to the carousel and arranged symmetrically with respect the rotation axis of the carousel, the first reel (BB1) being mounted on said first reel holder (B1) and the second reel (BB2) being mounted on the second reel holder (B2), the method comprising the steps of:

detecting the approaching exhaustion of the material (T) unwound from the first reel (BB1) mounted on the reel-holder (B1) of the apparatus standing in the working position;

blocking, either by stopping a machine to which the band of material (T) is fed or by means of a brake (FR), the forwarding movement of the material (T) unwound from the exhausting first reel (BB1) which is mounted on the reel-holder (B1) of the apparatus which stands in the working position;

cutting the material (T) unwound from said exhausting first reel;

driving retraction of the mobile support (SS) for bringing said exhausting first reel to the rest position;

causing rotation of the carousel (GS); and driving forward movement of the mobile support (SS) for bringing to the working position the second reel mounted on the second reel-holder (B2).

* * * * *